US006653803B1

(12) United States Patent
DiVergilio et al.

(10) Patent No.: US 6,653,803 B1
(45) Date of Patent: Nov. 25, 2003

(54) INTEGRATED RESONATOR AND AMPLIFIER SYSTEM

(75) Inventors: William F. DiVergilio, Beverly, MA (US); Kourosh Saadatmand, Merrimac, MA (US); Ernst F. Scherer, Hamilton, MA (US)

(73) Assignee: Axcelis Technologies, Inc., Beverly, MA (US)

( * ) Notice: Subject to any disclaimer, the term of this patent is extended or adjusted under 35 U.S.C. 154(b) by 622 days.

(21) Appl. No.: 09/583,157

(22) Filed: May 30, 2000

(51) Int. Cl.[7] ..... H05H 9/00; H01J 23/00

(52) U.S. Cl. ..... 315/505; 315/5.41; 250/492.21; 313/360.1

(58) Field of Search ..... 315/505, 5.41; 250/492.21; 313/360.1

(56) References Cited

U.S. PATENT DOCUMENTS 4,667,111 A * 5/1987 Glavish et al. ..... 250/492.2
5,504,341 A * 4/1996 Glavish ..... 250/492.21
6,262,638 B1 7/2001 Scherer

FOREIGN PATENT DOCUMENTS

EP 0996316 A1 4/2000

* cited by examiner

*Primary Examiner*—Nikita Wells
(74) *Attorney, Agent, or Firm*—Eschweiler & Associates, LLC

(57) ABSTRACT

An integrated RF amplifier and resonator is provided for use with an ion accelerator. The amplifier includes an output substantially directly coupled with a resonator coil. The amplifier output may be coupled capacitively or inductively. In addition, an apparatus is provided for accelerating ions in an ion implanter. The apparatus comprises an amplifier with an RF output, a tank circuit with a coil substantially directly coupled to the RF output of the amplifier, and an electrode connected to the coil for accelerating ions. Also provided is a method for coupling an RF amplifier with a resonator in an ion accelerator. The method comprises connecting the RF output of the amplifier to a coupler, and locating the coupler proximate the coil, thereby substantially directly coupling the RF output of the amplifier with the resonator coil.

16 Claims, 11 Drawing Sheets

INTEGRATED RESONATOR AND AMPLIFIER SYSTEM

FIELD OF THE INVENTION

The present invention relates generally to ion implantation systems, and more specifically to an improved ion implanter linear accelerator energizing apparatus and system.

BACKGROUND OF THE INVENTION

In the manufacture of semiconductor devices, ion implantation is used to dope semiconductors with impurities. A high energy (HE) ion implanter is described in U.S. Pat. No. 4,667,111, assigned to the assignee of the present invention, Eaton Corporation, which is hereby incorporated by reference as if fully set forth herein. Such HE ion implanters are used for deep implants into a substrate in creating, for example, retrograde wells. Implant energies of 1.5 MeV (million electron volts), are typical for the deep implants. Although less energy can be used, the implanter still must be capable of performing implants at energies between 300 keV and 700 keV. Eaton GSD/HE and GSD/VHE ion implanters can provide ion beams at energy levels up to 5 MeV.

Referring to FIG. 1*a*, a typical high energy ion implanter 10 is illustrated, having a in terminal 12, a beamline assembly 14, and an end station 16. The terminal 12 includes an ion source 20 powered by a high voltage power supply 22. The ion source 20 produces an ion beam 24 which is provided to the beamline assembly 14. The ion beam 24 is then directed toward a target wafer 30 in the end station 16. The ion beam 24 is conditioned by the beamline assembly 14 which comprises a mass analysis magnet 26 and a radio frequency (RF) linear accelerator (linac) 28. The linac 28 includes a series of resonator modules 28*a*–28*n*, each of which further accelerates ions beyond the energies they achieve from prior modules. The accelerator modules are individually energized by a high RF voltage which is typically generated by a resonance method to keep the required average power reasonable. The mass analysis magnet 26 passes only ions of appropriate charge-to-mass ration to the linac 28.

The linear accelerator modules 28*a*–28*n* in the high energy ion implanter 10 individually include an RF amplifier 50, a resonator 52, and an electrode 54 as schematically illustrated in FIG. 1*b*. The resonators, for example, as described in U.S. Pat. No. 4,667,111 operate at a frequency in the range of about 3–30 Mhz, with a voltage of about 0 to 150 kV, in order to accelerate ions of the beam 24 to energies over one million electron volts per charge state. A conventional connection of power between an RF amplifier 50 and a resonator 52 includes a first impedance matching network 56 within the amplifier 50 to match the active devices 51, which may be solid state or vacuum tube devices, to the transmission line 58 impedance, typically 50 OHMs. A second matching network 60 at the feed into the resonator 52 matches the transmission line impedance to the resonator load impedance. The power losses due to the matching networks 56 and 60, as well as the cable 58 are typically 2–5% of the total RF power. In addition, such matching networks and transmission lines or cables are costly. Further, the length of the cable 58 is critical, and an optimal cable length for matching purposes may include several meters of cable which occupies valuable space a in a typical high energy ion implantation system.

SUMMARY OF THE INVENTION

The present invention is directed to an integrated resonator and radio frequency (RF) amplifier system and apparatus for use in an ion accelerator, which eliminates or minimizes various problems associated with the prior art. In particular, the invention combines the previous multiple matching networks into a single network, thereby reducing the complexity and cost of an integrated resonator and RF amplifier system. The invention further provides a method of coupling an RF amplifier with a resonator.

In accordance with one aspect of the invention, an integrated resonator and amplifier system is provided wherein an RF output associated with the amplifier is substantially directly coupled to the resonator, thereby eliminating the costs associated with one or more matching networks and cables associated with prior art systems and devices. The system may comprise an amplifier having an RF output, a tank circuit substantially directly coupled to the RF output of the amplifier, and an accelerating electrode connected to the tank circuit. In addition to cost advantages, the present invention reduces the space required for an accelerator module. The present invention, moreover, eliminates or reduces the power losses associated with the eliminated networks and cable, thereby improving overall system efficiency. The reduction in the number of RF components according to the invention also advantageously improves the system reliability.

In accordance with another aspect of the invention, an apparatus is provided for accelerating ions in an ion implanter. The apparatus may comprise an amplifier having an RF output, a tank circuit having a coil substantially directly coupled to the RF output of the amplifier, and an electrode connected to the coil for accelerating ions.

In accordance with yet another aspect of the invention, a method of coupling an RF amplifier with a resonator in an ion accelerator is provided. The method comprises connecting an RF output of an amplifier to a coupler, and locating the coupler near a resonator coil, thereby coupling the RF output of the amplifier with the resonator. In addition, the invention provides for capacitive or inductive coupling of an RF amplifier with an ion accelerator resonator.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

Figure 1A:
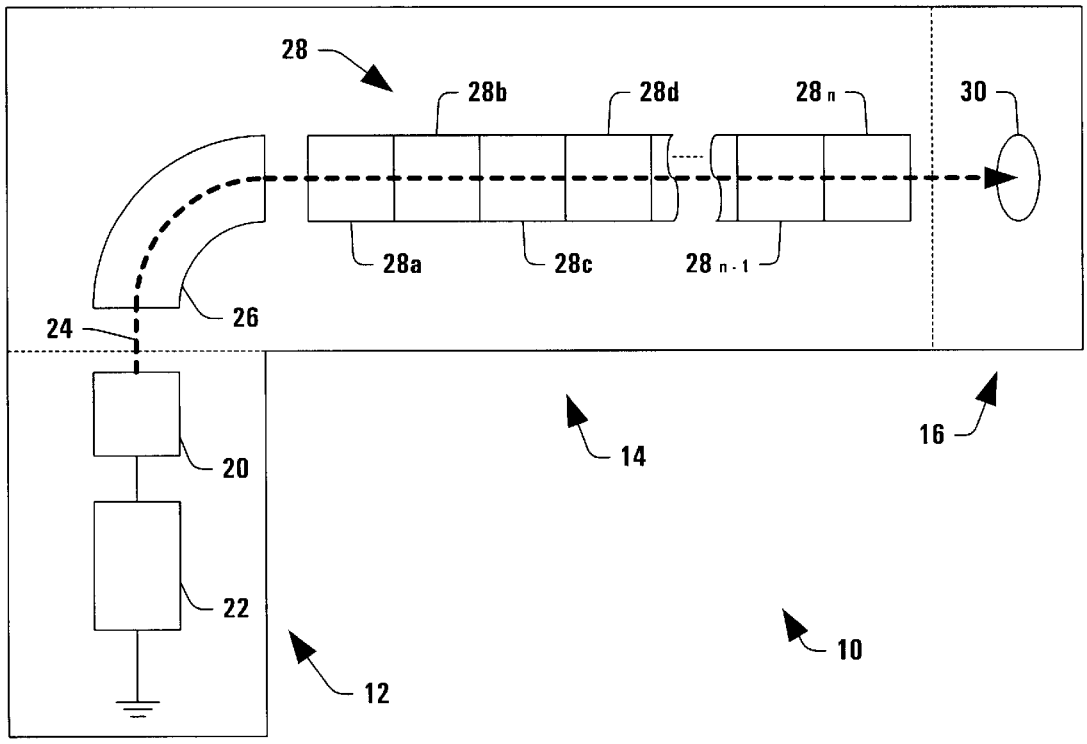
FIG. 1*a* is schematic a block diagram illustrating a typical high energy ion implanter having a linear accelerator in which the integrated RF amplifier and resonator system and method of the present invention may be employed.
Figure 1B:
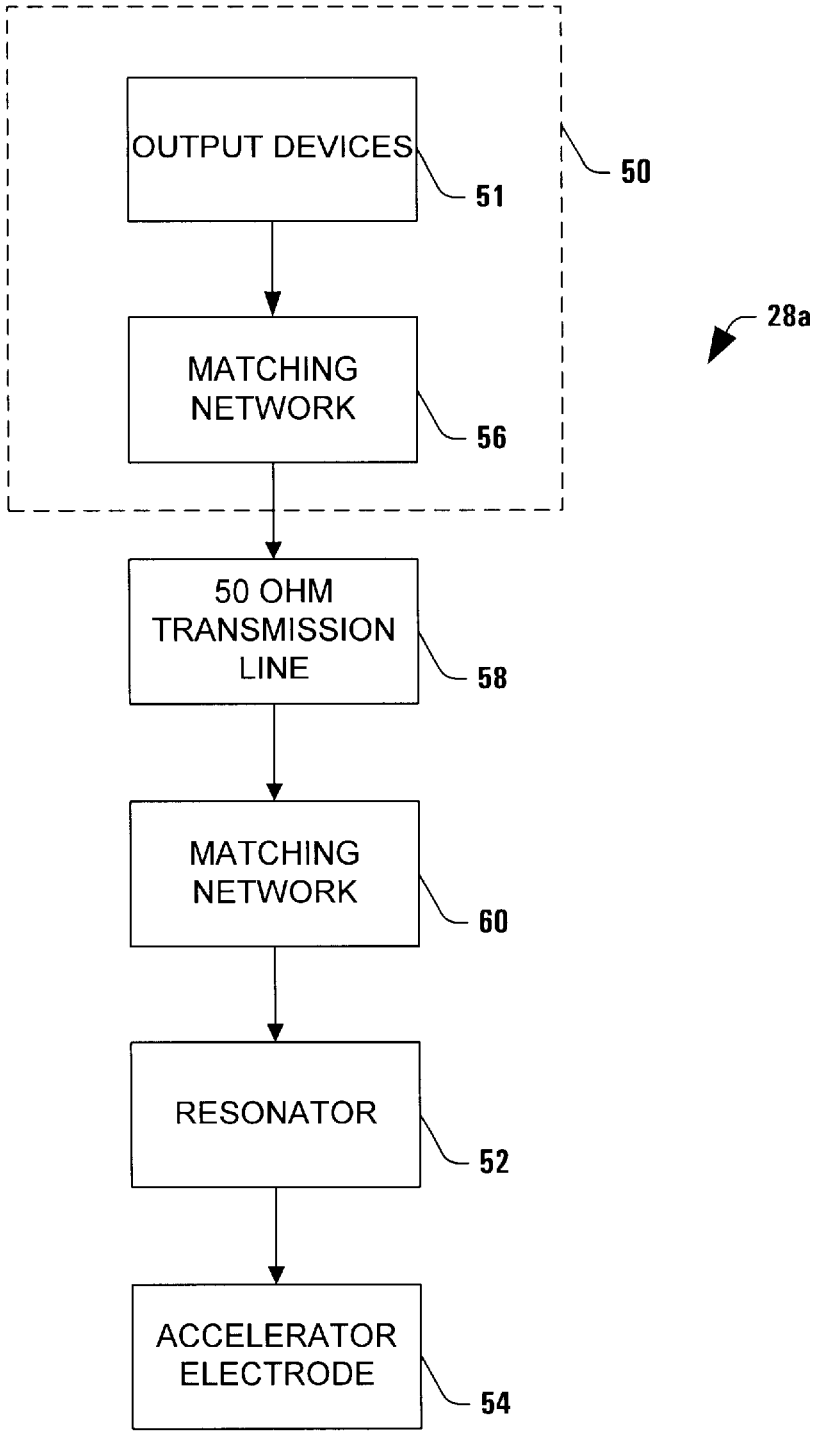
FIG. 1b (PRIOR ART)
FIG. 1*b* is a schematic block diagram illustrating a prior art linear accelerator module.

The present invention will now be described with reference to the drawings wherein like reference numerals are used to refer to like elements throughout. The present invention includes an integrated resonator and RF amplifier system and apparatus for use in an ion accelerator, as well as a method for coupling an RF amplifier with a resonator in an ion accelerator. The invention may be employed in individual accelerator modules within a linear accelerator in a high energy implantation system. One aspect of the invention comprises coupling substantially directly an RF amplifier output to a resonator circuit. The substantially direct coupling of the invention may comprise, for example, capacitive, inductive, and transformer coupling, etc., and advantageously simplifies the prior art matching networks and eliminates the 50 OHM cable associated with conventional systems, thus improving efficiency, space utilization, cost, and reliability.

The various aspects of the present invention will be discussed hereinafter, in reference to specific applications including a linear accelerator module forming a component in a high energy ion implantation system. However, it will be appreciated that the invention finds utility in other applications. In order to provide context for the features of the invention, a brief discussion of a conventional interconnection for an RF amplifier and resonator is now provided.

Figure 1C:
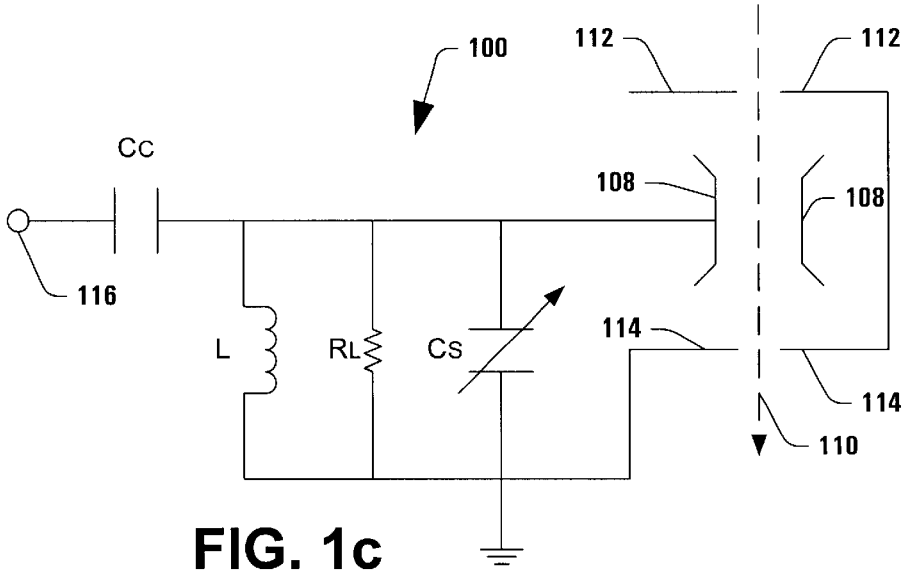
FIG. 1c (PRIOR ART)
FIG. 1*c* is a schematic diagram illustrating a conventional linear accelerator module.

Referring to FIG. 1*c*, a conventional resonator circuit 100 is illustrated which includes an inductor coil L connected in parallel with a resistance $R_L$ and a capacitance $C_S$. An accelerating electrode 108 is connected to the inductor L, and serves to accelerate ions associated with an ion beam 110. The electrode 108 is mounted between two grounded electrodes 112 and 114, and the accelerating electrode 108 and the grounded electrodes. 112 and 114 operate in a "push-pull" manner to accelerate the ion beam 110. The capacitance $C_S$ represents the equivalent capacitance of the resonator circuit, including contributions from the accelerating electrode 108, the support stem for the electrode, the coil and any added tuning capacitance. The resistance $R_L$ represents the losses associated with the resonant circuit comprising the inductor L and the capacitance $C_S$. The values for the capacitance $C_S$ and the inductor coil L are selected to form a low loss (high Q) resonant or "tank" circuit 100, wherein each accelerator module in a linear accelerator system of the type shown in FIG. 1*a* resonates at the same frequency. A radio frequency (RF) signal is connected from an RF system (not shown) at point 116 and is capacitively coupled to a high voltage end of the coil L via a capacitor $C_C$.

Figure 1D:
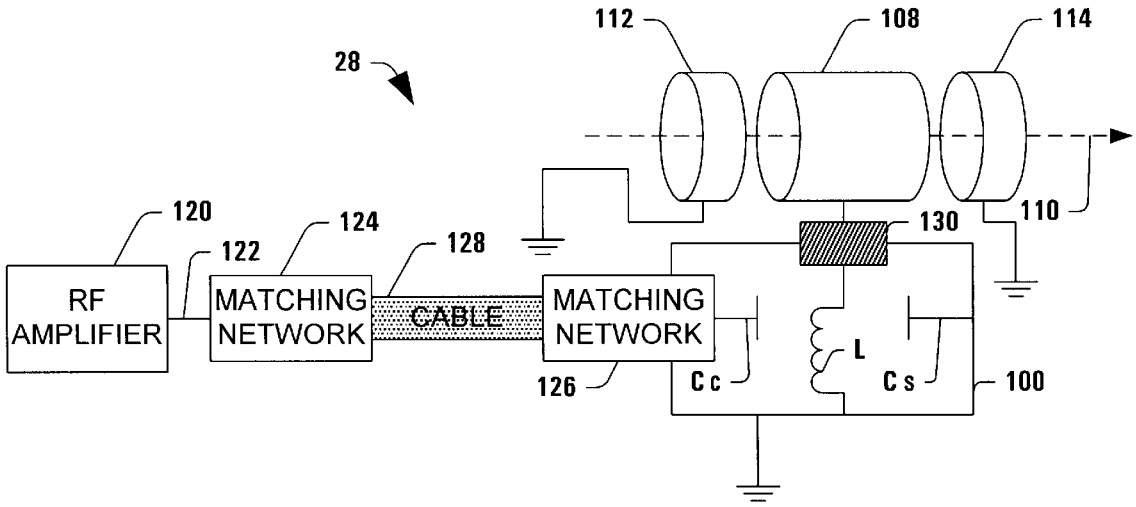
FIG. 1d (PRIOR ART)
FIG. 1*d* is a schematic block diagram illustrating a conventional linear accelerator module.

Referring also to FIG. 1*d*, an accelerator module 28 is shown including an RF amplifier 120 with an RF output 122 connected to the resonator circuit 100 of FIG. 1*c* via first and second matching networks 124 and 126 and a cable 128, which is typically a conventional 50 OHM coaxial cable. The cable 128 typically has a length of several meters, in order to properly match the impedance of the amplifier output 122 with that of the resonator circuit 100. The matching network 126 couples to the resonator circuit 100 and may include the coupling capacitor $C_C$ and/or other elements. The coupling capacitor $C_C$ has a plate spaced from the inductor coil L, and is adjustable to match the impedance of the resonator circuit impedance $R_L$ (typically 1 MOHM) with that of the RF source, including the amplifier 120, the matching network 124, and the cable 128 (typically 50 OHMs). Similarly, the resonant capacitance $C_S$ has a plate spaced from the coil L which may be adjusted to tune the resonant frequency of the resonator 100 circuit. The coil L is connected to the accelerator electrode 108 through a high voltage bushing 130.

The matching network 124 is typically configured to match the output impedance of the amplifier 120 with the cable 128. The matching network 126 serves to match the impedance of the cable 128, network 124, and the amplifier 120 with that of the load, which in FIG. 1*d* is the resonator 100. The coupling capacitor $C_C$ contributes to the impedance of the resonator circuit 100, and is generally fixed. The matching networks 124 and 126, as well as the cable 128 are expensive, may require maintenance, and occupy valuable space in the linac 28. Simplification of these components 124, 126, and elimination of 128 by the present invention therefore improves the system cost, reliability, space utilization, and performance.

Figure 2A:
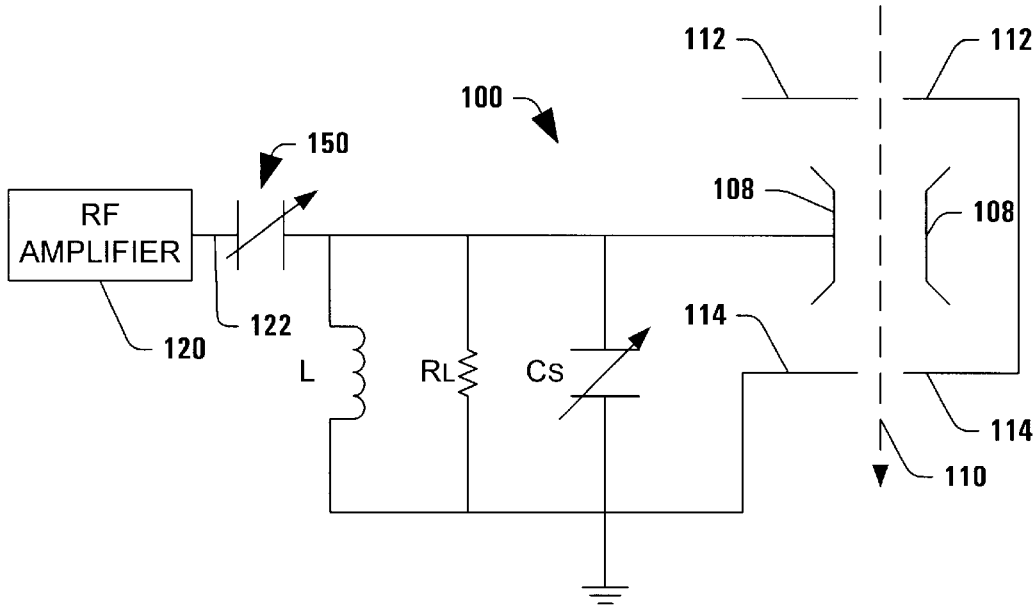
FIG. 2*a* is a schematic diagram illustrating an integrated RF amplifier and resonator system having capacitive coupling according to an aspect of the invention.
Figure 2B:
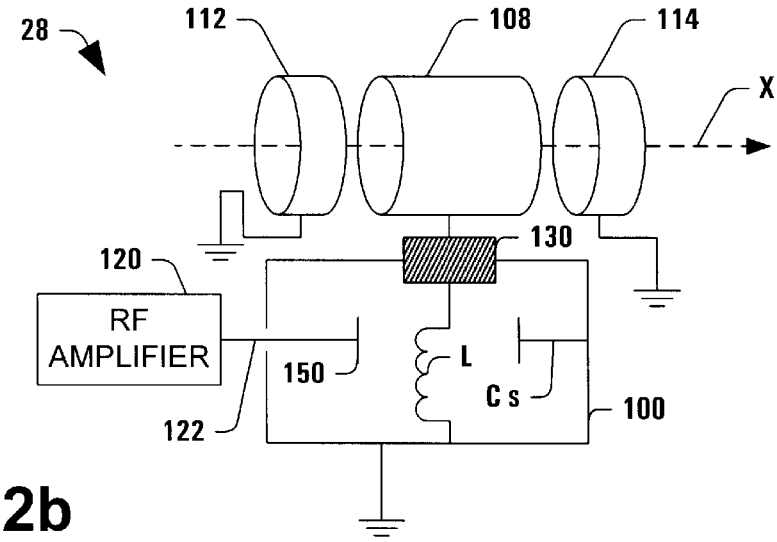
FIG. 2*b* is a schematic block diagram illustrating an integrated RF amplifier and resonator system according to another aspect of the invention.

Referring now to FIGS. 2*a* and 2*b*, one aspect of the present invention is illustrated comprising an integrated resonator and RF amplifier system for use in an ion accelerator. The illustrated system accomplishes a low loss, substantially direct coupling between an RF amplifier 120 and a high Q resonant circuit 100 through simplification of the matching networks and elimination of the cable of the prior systems. The invention may be employed advantageously in linear accelerator modules forming a linac stage for high energy (HE) ion implanters. The system has an amplifier 120 with an RF output 122 coupled substantially directly to a resonant circuit 100 through a coupling capacitor 150 connected to a high voltage end of a resonator circuit inductor coil L.

Figure 2C:
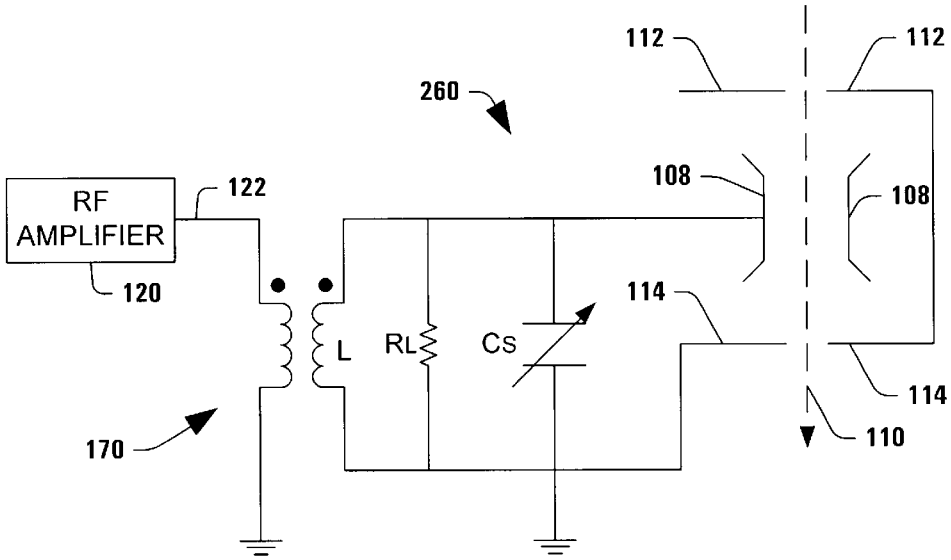
FIG. 2*c* is a schematic diagram illustrating an integrated RF amplifier and resonator system having inductive coupling according to another aspect of the invention.

Substantially direct coupling comprises capacitive coupling such as via a series capacitance (e.g., capacitor 150 in FIG. 2*b*), inductive coupling via an inductor loop or coil (e.g., coupling coil 170 as illustrated in FIG. 2*c* and described infra), and the like. Substantially direct coupling, as used herein, does not include the multiple matching networks and cables associated with prior systems, but instead contemplates a single coupling network adapted to match the impedance of an amplifier RF output with a resonator circuit.

The coil L forms a resonant or tank circuit with a capacitance $C_S$ which may be adjustable for tuning of the resonant frequency of the tank circuit. As illustrated in FIGS. 2*a* and 2*b*, no additional matching networks or 50 OHM cables are required in the present invention. The impedance of the RF amplifier 120 at the output 122 is matched to the resonator impedance by the capacitance 150, the value of which is adjustable. However, the adjustment of the capacitance is generally done once depending on the impedance of the resonator circuit 100. Further adjustment is generally not required since the load of the resonator circuit 100 does not vary significantly during operation. The efficiency, reliability, and cost of the inventive system are superior to that of the prior art due to the elimination of impedance matching components, and the power losses associated therewith.

Referring now to FIG. 2*c*, an integrated resonator and RF amplifier system is illustrated which provides a substantially direct coupling between an RF amplifier 120 and a high Q resonant circuit 260, without additional matching networks and cable of the prior systems. The system has an amplifier 120 with an RF output 122 coupled substantially directly to a resonant circuit 260 through a coupling coil 170. The coil 170 provides inductive coupling of the RF output 122 with the resonator circuit inductor coil L, which inductive coupling may comprise impedance matching between the output 122 of the amplifier 120 and the resonant circuit 260. Like the resonant circuit 100 of FIG. 2*a*, circuit 260 comprises coil L and a capacitance $C_S$ which may be adjustable for tuning of the resonant frequency of the tank circuit. The inductive coupling between coupling coil 170 and resonator coil L may be adjustable in order to match the impedance of the RF amplifier 120 at the output 122 with that of the resonator circuit 260.

Figure 2D:
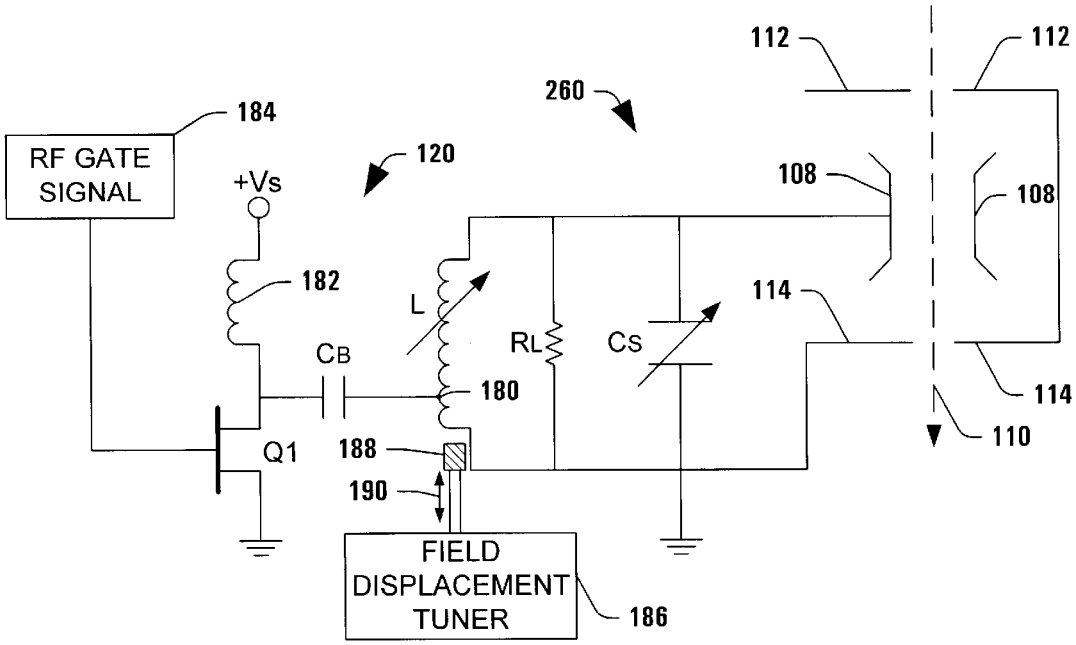
FIG. 2*d* is a schematic diagram illustrating another integrated RF amplifier and resonator system having inductive coupling according to another aspect of the invention.

FIG. 2*d* illustrates yet another application of substantially direct galvanic coupling between an RF amplifier 120 and the high Q resonant circuit 260, in which one end of a coupling capacitor $C_B$ is connected to the variable inductor L of the circuit 260 at a tap point 180 to provide an amplified RF signal (not shown) from a power FET Q1 to the inductor L. An RF choke 182 may be connected between the source of Q1 and a positive supply voltage source +Vs, and an RF gate signal 184 is provided to the gate of Q1. By choosing an appropriate tap point 180, virtually any impedance level may be achieved, down to impedances on the order of a few Ohms. This is particularly useful in conjunction with high power solid-state amplifiers having very low output impedances (e.g., FET Q1). The coupling capacitor $C_B$ has no impedance transforming function in the integrated amplifier/resonator of FIG. 2*d*, instead having high enough capacitance to block the DC transistor voltage of Q1 from being shorted by the inductor L. It will be noted that no additional impedance matching components are required other than the resonator circuit 260 itself. The inductor L value may be tuned using a field displacement tuner 186 having a plunger 188 movable with respect to the inductor coil L in the direction 190.

Figure 3:
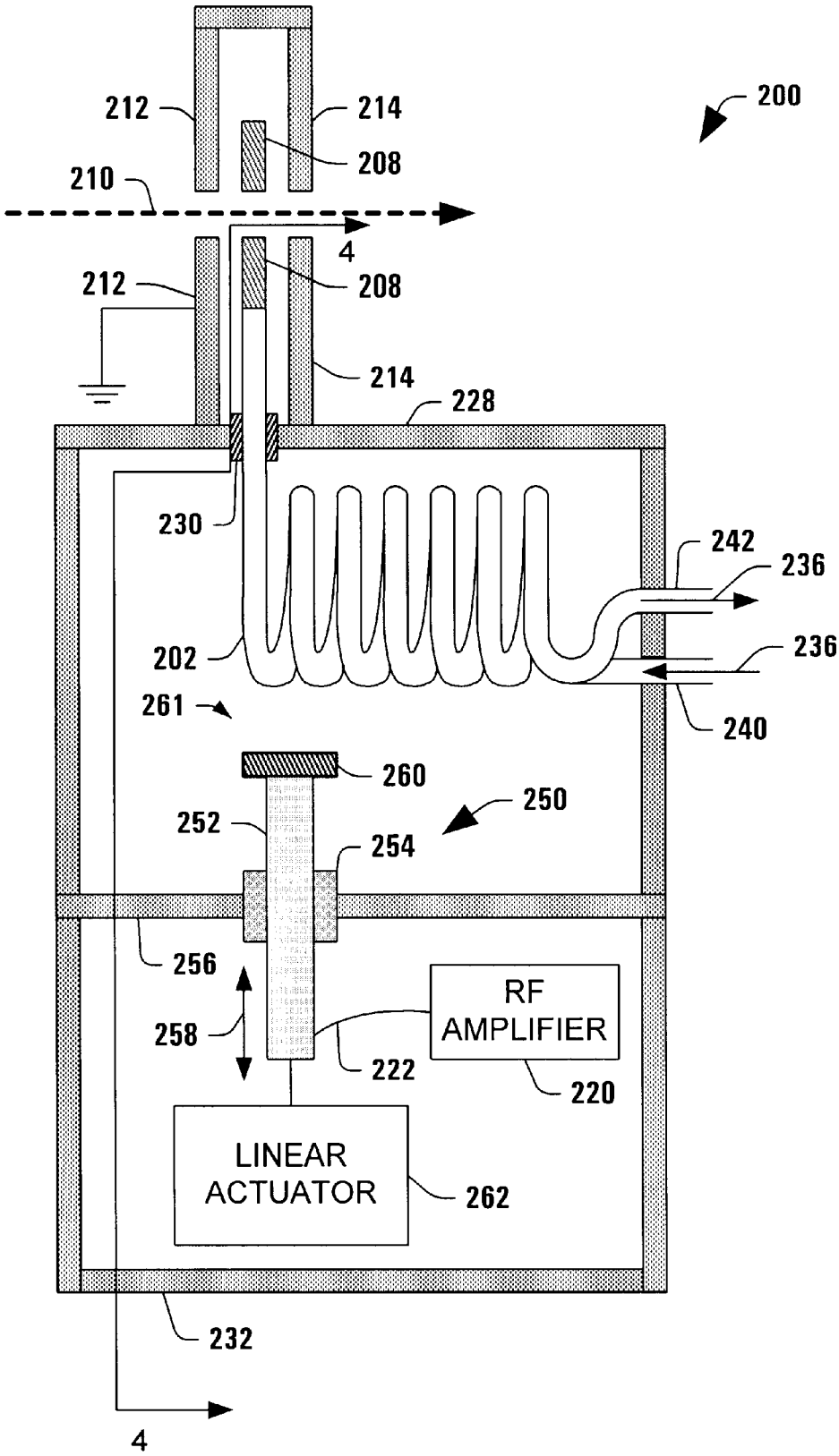
FIG. 3 is a sectional plan view illustrating an integrated RF amplifier and resonator system according to the invention.
Figure 4:
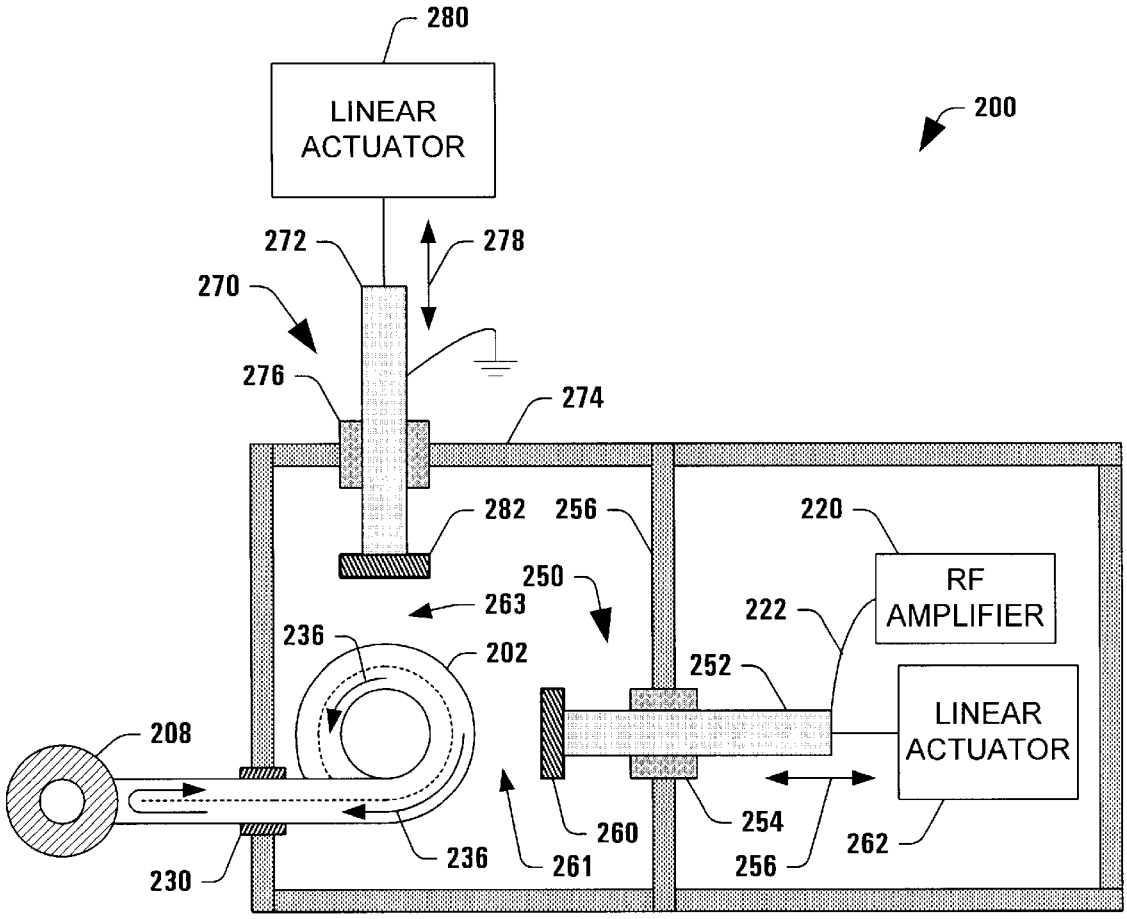
FIG. 4 is a side elevation view in section of an integrated RF amplifier and resonator system according to the invention, taken along line 4—4 of FIG. 3.

FIG. 3, is a detailed top view drawing illustrating one embodiment of the present invention in which an integrated resonator and RF amplifier system 200 is shown with a resonator inductor coil 202 having a cylindrical accelerating electrode 208 for accelerating an ion beam 210, and mounted between grounded electrodes 212 and 214. The accelerating electrode 208 and grounded electrodes 212 and 214 operate in a push-pull fashion to accelerate packets of charged particles in the beam 210 as they pass through the system 200. The high voltage end of coil 202 passes through the outer housing wall 228 via a bushing 230. Coil 202 is bifurcated, providing for circulation of cooling water 236 into and out of inlet 240 and outlet 242, respectively. The inlet 240 and outlet 242 are located at a low voltage end of the coil 202, which is connected to the housing wall. An RF amplifier 220 and a capacitor 250, providing an adjustable capacitive coupling of the output 222 to the coil 202, are also included in the system 200, together with an adjustable tuning capacitance 270 which is illustrated in FIG. 4 and described below, but has been omitted from FIG. 3 for simplicity. It will be appreciated that the system 200 is one implementation of a linac module 28 illustrated in FIG. 2B, where, for example, inductor coil L corresponds with coil 202, the coupling capacitor 250 corresponds with capacitor 150, etc.

The adjustable capacitor 250 comprises a rod 252 slidably engaging a high voltage bushing 254 in an inner wall 256 of the system housing 232 for linear reciprocation of the rod 252 in relation to the coil 202 in the direction shown by arrow 258. The rod 252 may be made of aluminum and is electrically connected to the output 222 of the RF amplifier 220. The capacitor 250 further comprises a conductive plate 260 spaced from the coil 202. The plate 260 and the gap 261 between the plate 260 and the coil 202 form the capacitor 250 which capacitively couples the RF output 222 to the coil 202. The substantially direct coupling of the output 222 to the coil 202 via the adjustable capacitor 250 allows elimination of one of the matching networks and cables associated with prior systems. In FIG. 3, the capacitor 250 further includes a linear actuator 262, such as a motor or solenoid, for reciprocating the rod 252, and hence the plate 260, in the direction of the arrow 258. Although the adjustable capacitor 250 is illustrated as having an adjustable gap 261 between the plate 260 and the coil 202, it will be appreciated that many different types of adjustable capacitors may be used to couple the RF output 222 to the coil 202, and are deemed to fall within the scope of the present invention.

The linear actuator 262 provides for adjustment of the capacitive coupling between the coil 202 and the amplifier output 222. The adjustment of the capacitor 250 may be manual or automatic in combination with control systems or other instrumentation (not shown). However, it will be appreciated that the system may alternatively be provided with a fixed capacitance 250 with a value selected for optimal matching between the amplifier output 222 and the resonator circuit impedance, wherein no linear actuator 262 is required, and no reciprocation of the aluminum rod 252 or plate 260 is provided.

FIG. 4 illustrates a side elevation view of the system of FIG. 3, and further including a tuning capacitance 270 for controllable adjustment or tuning of the resonant frequency of the resonator circuit formed by the capacitor 270 and the inductor coil 202. The capacitor 270 comprises a conductive rod 272 passing through the housing wall 274 via a bushing 276, and slidingly engaging therewith for linear reciprocation of the rod 272 in the direction shown by the arrow 278 via a linear actuator 280. The tuning capacitor 270 further comprises a conductive plate 282 spaced from the inductor coil 202, near a high voltage end thereof. A gap 263 is thus formed between the plate 282 and the coil 202, thereby providing a capacitance to ground in parallel with the inductor coil 202. The resonant frequency of the tank circuit may be adjusted automatically or manually via the linear actuator 280 as may be desired. In the illustrated embodiment of FIGS. 3 and 4, the coupling capacitor 250 as well as the tuning capacitor 270 capacitively couple with the inductor coil 202 near the high voltage end thereof.

The system 200 of FIGS. 3 and 4 illustrates several of the advantages of the present invention. The substantially direct coupling of the RF output 222 of the amplifier 220 through the capacitor 250 eliminates the need for additional expensive matching networks and cables required in prior systems. The reliability of the inventive system is increased and the cost thereof is reduced because there are less RF components. The system is also compact, since the additional matching networks, as well as several meters of cable typical in the past, have been eliminated. Moreover, the system of the present invention is more efficient because the power losses formerly associated with matching networks and cables are avoided.

Figure 5:
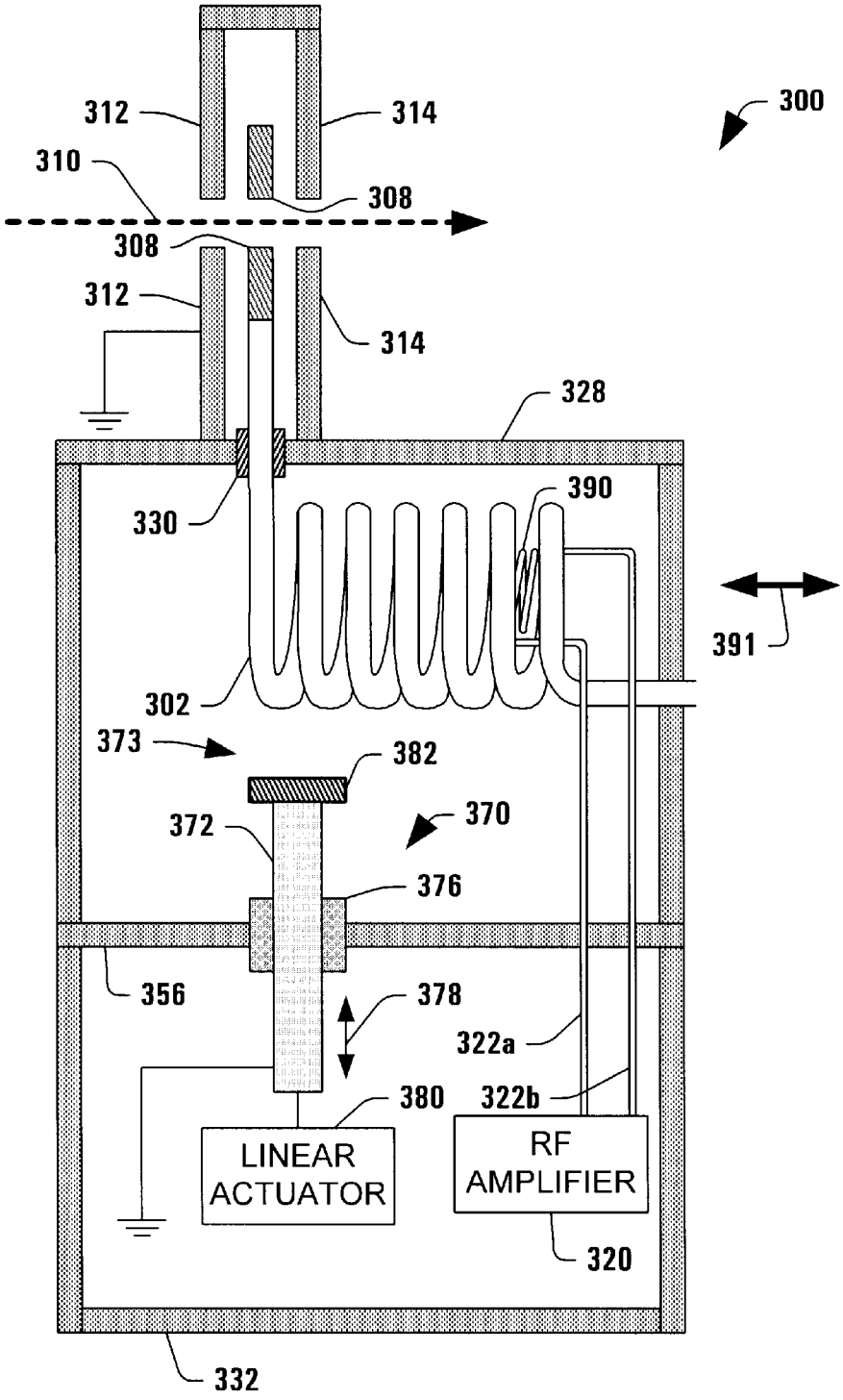
FIG. 5 is a sectional plan view illustrating an integrated RF amplifier and resonator system according to an aspect of the invention.

Referring now to FIG. 5, another embodiment of the invention is illustrated, comprising an integrated resonator and amplifier system 300 with an RF amplifier 320 having outputs 322*a* and 322*b*, and a resonator inductor coil 302 with a cylindrical accelerator electrode 308. The high voltage end of coil 302 passes through the end wall 328 of the housing 332 via a bushing 330, whereby the accelerating electrode 308 operates in a push-pull fashion with grounded electrodes 312 and 314 to accelerate ions forming a beam 310. In this exemplary embodiment, a second inductor coil or loop 390 inductively couples the output 322 of amplifier 320 with a low voltage end of the coil 302. As with the capacitive coupling illustrated in FIGS. 3 and 4, the substantially direct inductive coupling via the loop 390 in FIG. 5 eliminates the additional matching networks and cables associated with prior systems. The loop 390 is preferably located concentric with the coil 302 and may be moved in the direction of arrow 391 to thereby adjust the inductive coupling of the RF amplifier output 322 to the coil 302. This also provides for adjustable impedance matching in the system 300.

A tuning capacitor 370 is provided, having a conductive rod 372 with a conductive end plate 380, and slidingly engaging a bushing 376 through an inner housing wall 356. Linear reciprocation of the rod 372 in the direction shown by arrow 378 is provided by a linear actuator 380. The rod 372 and the plate 382 are electrically grounded, and the plate 382 is spaced from a high voltage end of the coil 302, forming a gap 373 there between. The value of the capacitor 370 may be adjusted manually or automatically via the linear actuator 380 in order to tune the resonant frequency of the tank circuit. The substantially direct coupling of the RF output 322 with the inductor coil 302, through the inductor loop 390, provides advantages in cost, reliability, space savings, and efficiency, by the elimination of the additional matching networks and cables required in conventional systems.

Figure 6A:
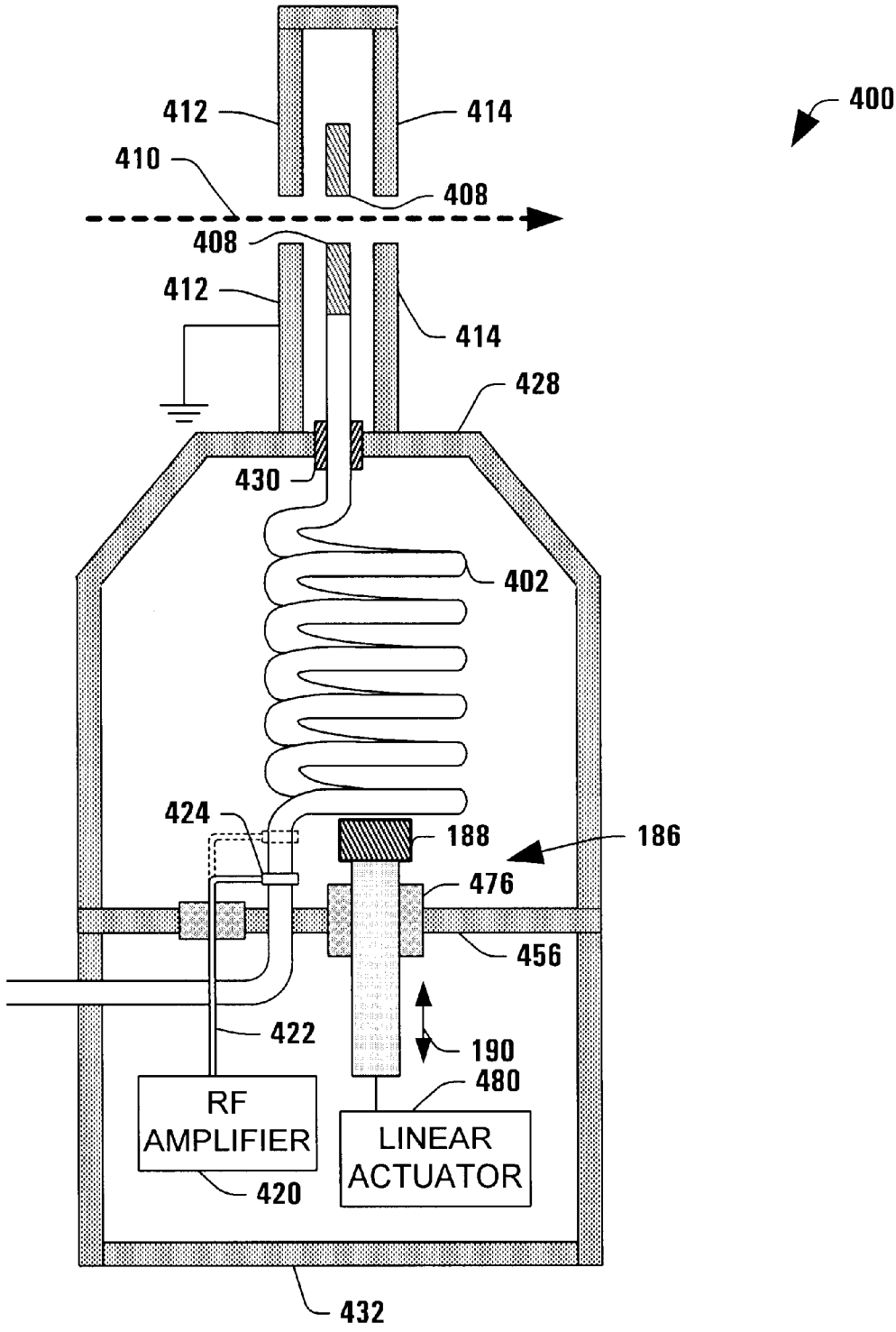
FIG. 6*a* is a sectional plan view illustrating another integrated RF amplifier and resonator system according to another aspect of the invention.

In FIG. 6*a*, another aspect of the invention is illustrated, comprising an integrated resonator and amplifier system 400 with an RF amplifier 420 having an output 422, and a resonator inductor coil 402 with a cylindrical accelerator electrode 408. The high voltage end of coil 402 passes through the end wall 428 of the housing 432 via a bushing 430, whereby the accelerating electrode 408 operates in a push-pull fashion with grounded electrodes 412 and 414 to accelerate ions forming a beam 410. The output 422 of amplifier 420 is coupled to a low voltage end of the coil 402 via a connector pad 424. This galvanic coupling of RF power from the amplifier 420 with the resonator coil 402 provides for impedance matching of the amplifier output with the resonator circuit impedance. The pad 424 may be located on the coil 402 at various positions, another of which is illustrated in phantom in FIG. 6*a*. The location of the pad 424 on the coil 402 may be adjusted to match the impedance of the resonator circuit with the amplifier 420. The use of the relocatable connector pad 424 thereby provides impedance matching without the need for additional matching components.

A field displacement tuner 186 is provided having a plunger 188 movable with respect to the inductor coil 402 in the direction 190, and passing through a wall 456 via a bushing 476. The linear reciprocation of the plunger 472 may be facilitated by a linear actuator 480. The value of the inductor coil 402 may thus be adjusted manually or automatically via the linear actuator 480 in order to tune the resonant frequency of the tank circuit by changing the amount of flux through the coil 402.

Figure 6B:
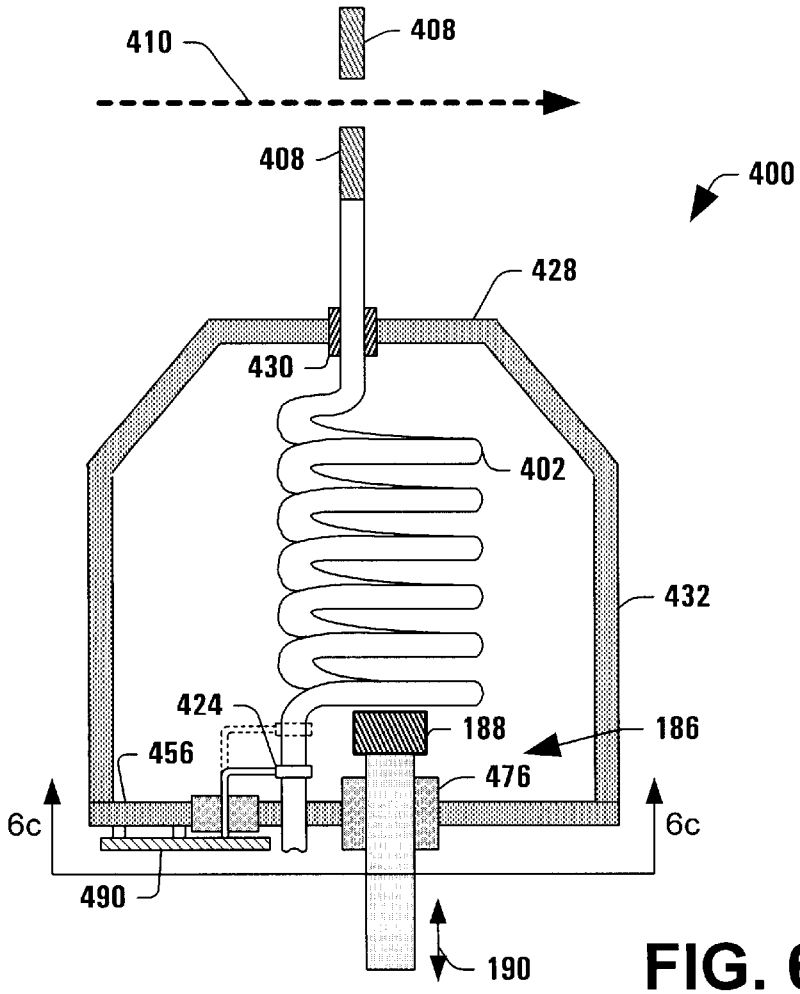
FIG. 6*b* is a sectional plan view illustrating another integrated RF amplifier and resonator system according to another aspect of the invention.
Figure 6C:
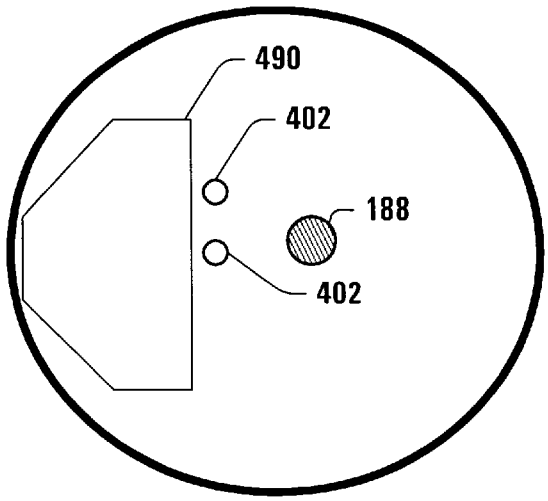
FIG. 6*c* is an elevation view of the integrated RF amplifier and resonator system of FIG. 6*b*.

FIGS. 6*b* and 6*c* illustrate another aspect of the invention wherein an integrated resonator and amplifier system 400 includes a hybrid integrated power stage 490 attached to the outside of the wall 456 of the housing 432, and a field displacement tuner 186 having a plunger 188 movable with respect to the inductor coil 402 in the direction 190. The power stage 490 has an RF output for connection with the resonator coil 402 via the connector pad 42, and may comprise an RF amplifier and other control circuitry associated with the system 400. The location of the connector pad 424 on coil 402 provides for impedance matching between the amplifier of the power stage 490 and the coil 402. In addition, the location of the plunger 188 with respect to the coil 402 provides for tuning of the resonant circuit. The illustrated system of FIGS. 6*b* and 6*c* therefore provides substantially direct coupling of the RF output with the resonator without the need for additional matching components or circuitry.

Figure 7:
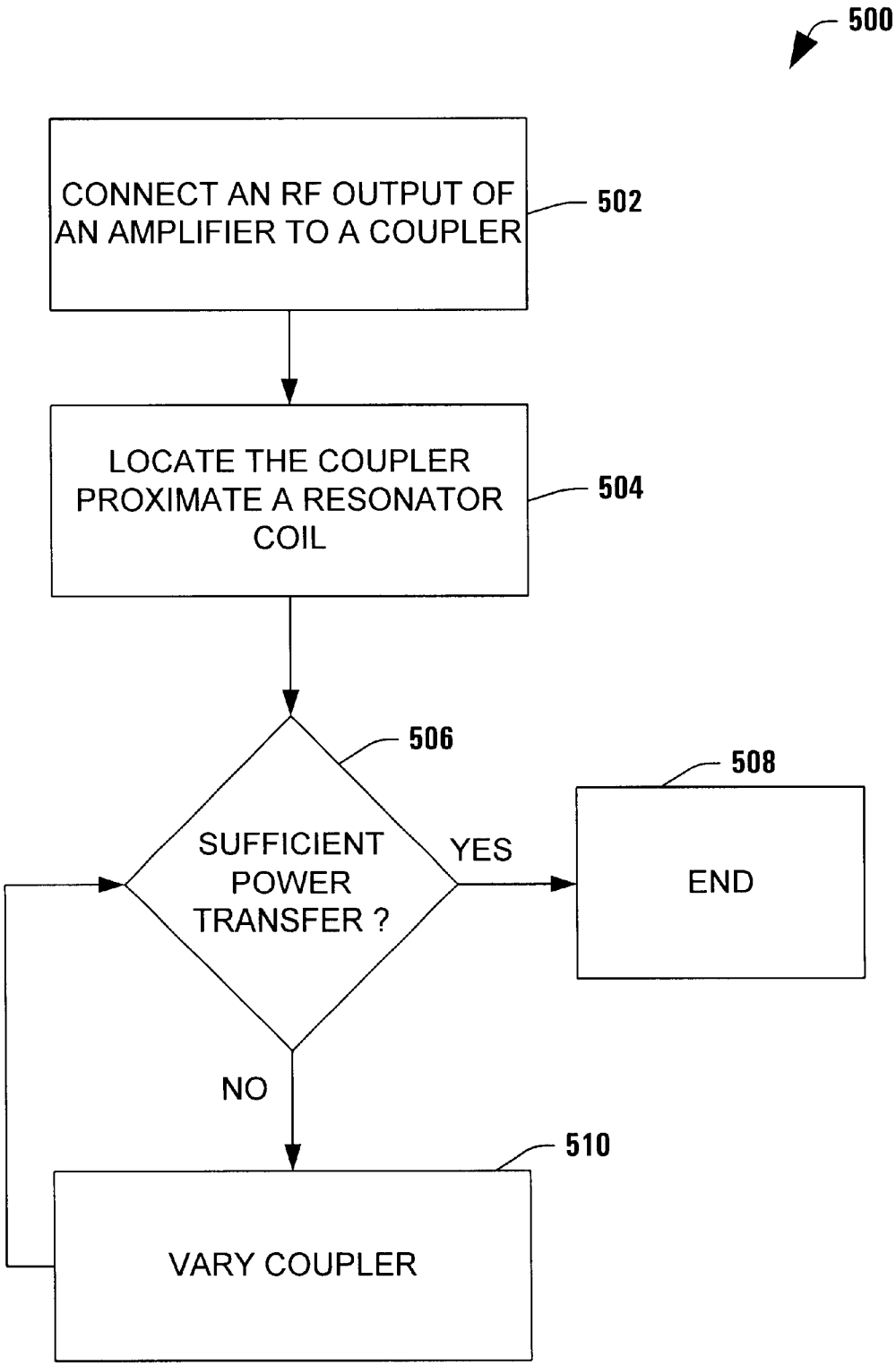
FIG. 7 is a flow diagram illustrating a method for coupling an RF amplifier output to a resonator or tank circuit.

Referring now to FIG. 7, a method 500 is illustrated for coupling an RF amplifier with a resonator in an ion accelerator. The method 500 comprises substantially directly coupling an RF amplifier output with a resonator or tank circuit. In step 502, an RF output of an amplifier is connected to a coupler (e.g. a capacitor or inductor). In step 504, the coupler is located proximate a resonator circuit coil, thereby coupling the RF output of the amplifier with the resonator or tank circuit. The power transfer is tested in step 506, and if the impedance matching allows sufficient power to be transferred from the amplifier to the load, the coupling is completed in step 508. Otherwise, the coupling is varied in step 510 in order to improve the power transfer.

The adjustment in step 510 may be accomplished, for example, via adjustment of the coupling capacitor 250 in FIGS. 3 and 4, or the coupling inductor 390 in FIG. 5. The adjustment proceeds through steps 506 and 510 until acceptable power transfer is achieved and the method ends in step 508. The sufficiency of the power transfer may be tested in step 506, for example, by dividing the amount of power transferred to the load by the power generated by the RF amplifier, and determining whether this fraction exceeds a minimally acceptable threshold. The illustrated method provides advantages over conventional methods which heretofore necessarily included providing and connecting matching networks and cables, as well as tuning the matching networks to match impedances between the amplifier output and the resonator coil.

Although the invention has been shown and described with respect to a certain embodiments, it will be appreciated that equivalent alterations and modifications will occur to others skilled in the art upon the reading and understanding of this specification and the annexed drawings. In particular regard to the various functions performed by the above described components (assemblies, devices, circuits, systems, etc.), the terms (including a reference to a "means")

used to describe such components are intended to correspond, unless otherwise indicated, to any component which performs the specified function of the described component (i.e., that is functionally equivalent), even though not structurally equivalent to the disclosed structure, which performs the function in the herein illustrated exemplary embodiments of the invention. In this regard, it will also be recognized that the invention includes a computer-readable medium having computer-executable instructions for performing the steps of the various methods of the invention. In addition, while a particular feature of the invention may have been disclosed with respect to only one of several embodiments, such feature may be combined with one or more other features of the other embodiments as may be desired and advantageous for any given or particular application. Furthermore, to the extent that the terms "includes", "including", "has", "having", and variants thereof are used in either the detailed description or the claims, these terms are intended to be inclusive in a manner similar to the term "comprising".

What is claimed is:

1. An integrated resonator and RF amplifier system for use in an ion accelerator, comprising:

an amplifier having an RF output;

a tank circuit substantially directly capacitively coupled to the RF output of the amplifier, and wherein the capacitive coupling includes a conductive member spaced from the coil, and wherein the conductive member is electrically connected to the RF output of the amplifier, thereby capacitively coupling the RF output of the amplifier with the coil; and an accelerating electrode connected to the tank circuit.

2. The system of claim 1, wherein the tank circuit includes a coil and a capacitance.

3. The system of claim 2, wherein the capacitance of the tank circuit is variable.

4. The system of claim 1, wherein the conductive member comprises an aluminum plate.

5. The system of claim 1, wherein the conductive member is operable to move with respect to the coil, thereby adjusting a spacing between the conductive member and the coil and thus the capacitance of the capacitive coupling.

6. An integrated resonator and RF amplifier system for use in an ion accelerator, comprising:

an amplifier having an RF output;

a tank circuit substantially directly inductively coupled to the RF output of the amplifier; and an accelerating electrode connected to the tank circuit.

7. The system of claim 6, wherein the tank circuit comprises a coil, wherein the inductive coupling includes an inductor positioned with respect to the coil near a low voltage end of the coil, and wherein the inductor is electrically connected to the RF output of the amplifier, thereby inductively coupling the RF output of the amplifier to the coil.

8. An apparatus for accelerating ions in an ion implanter, comprising:

an amplifier having an RF output;

a tank circuit having a coil associated therewith, the tank circuit being substantially directly capacitively coupled to the RF output of the amplifier, and wherein the capacitive coupling includes a conductive member spaced from the coil and movable with respect thereto, and wherein the conductive member is electrically connected to the RF output of the amplifier,; thereby capacitively coupling the RF output of the amplifier with the coil; and an electrode connected to the coil for accelerating ions.

9. The apparatus of claim 8, wherein the conductive member comprises an aluminum plate spaced from the coil, and wherein a spacing is adjustable to match an impedance of the amplifier, and the aluminum plate being connected to the RF output of the amplifier, thereby capacitively coupling the RF output of the amplifier with the coil.

10. The apparatus of claim 8, wherein the tank circuit includes a variable capacitor.

11. An apparatus for accelerating ions in an ion implanter, comprising:

an amplifier having an RF output;

a tank circuit having a coil associated therewith, the tank circuit being substantially directly inductively coupled to the RF output of the amplifier, and wherein the inductive coupling comprises an inductor positioned with respect to the coil near a low voltage end of the coil, and movable concentrically with respect thereto, the inductor being connected to the RF output of the amplifier, thereby inductively coupling the RF output of the amplifier to the coil.

12. A method for coupling an RF amplifier with a resonator in an ion accelerator, comprising:

providing an amplifier with an RF output;

providing a resonator having a coil with an electrode for accelerating ions, and a capacitance;

connecting the RF output of the amplifier to an adjustable coupler; and locating the adjustable coupler proximate the coil, thereby coupling the RF output of the amplifier to the resonator coil.

13. The method of claim 12, wherein the coupler comprises a plate and further comprising locating the plate near a high voltage end of the coil and spaced therefrom, thereby capacitively coupling the RF output of the amplifier to the coil.

14. The method of claim 12, wherein the coupler includes an inductor and further comprising locating the inductor near a low voltage end of the coil and concentric therewith, thereby inductively coupling the RF output of the amplifier to the coil.

15. The method of claim 13, further comprising varying the position of the plate, thereby adjusting the distance between the plate and the coil to adjust the coupling of the RF output of the amplifier to the resonator coil according to the power transfer there between.

16. The method of claim 14, further comprising varying the position of the inductor, thereby adjusting a positional relationship between the inductor and the coil to adjust the coupling of the RF output of the amplifier to the resonator coil according to the power transfer there between.

* * * * *